US006167876B1

(12) United States Patent
Uebele et al.

(10) Patent No.: US 6,167,876 B1
(45) Date of Patent: Jan. 2, 2001

(54) CIRCUIT ARRANGEMENT FOR AN IGNITION STAGE, IN PARTICULAR FOR THE IGNITION CIRCUIT OF A MOTOR VEHICLE

(75) Inventors: Manfred Uebele; Horst Meinders; Ning Qu, all of Reutlingen (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/202,671

(22) PCT Filed: Jun. 16, 1997

(86) PCT No.: PCT/DE97/01211

§ 371 Date: Sep. 7, 1999

§ 102(e) Date: Sep. 7, 1999

(87) PCT Pub. No.: WO97/48904

PCT Pub. Date: Dec. 24, 1997

(30) Foreign Application Priority Data

Jun. 20, 1996 (DE) ..... 196 24 530

(51) Int. Cl.[7] ..... F02P 1/00
(52) U.S. Cl. ..... 123/651; 315/209 T
(58) Field of Search ..... 123/651, 618; 315/209 T

(56) References Cited

U.S. PATENT DOCUMENTS 4,124,009 11/1978 Hill et al. .
4,462,356 7/1984 Hirt .
4,515,118 5/1985 Haubner et al. .
4,738,239 4/1988 Haines et al. .
5,529,046 6/1996 Werner et al. .
5,634,453 * 6/1997 Taruya et al. ..... 123/651
5,970,965 * 10/1999 Bentel et al. ..... 123/651

FOREIGN PATENT DOCUMENTS 3 735 631 5/1989 (DE) .

* cited by examiner

*Primary Examiner*—John Kwon
(74) *Attorney, Agent, or Firm*—Kenyon & Kenyon

(57) ABSTRACT

A circuit arrangement of an ignition output stage, in particular for an ignition circuit of a motor vehicle, is described. The circuit arrangement includes a multiple Darlington transistor (Darlington) which drives a primary winding of an ignition coil, as well as a driving circuit for the Darlington. An n-p-n Darlington is provided, whose collector is connected to the positive terminal of a voltage source and whose emitter is connected to a first terminal of the primary winding of the ignition coil. The second terminal of the primary winding is connected to ground. The Darlington is driven via a decoupling element which isolates the driving circuit from a negative reverse voltage present at the base of the Darlington when the latter is turned off.

8 Claims, 1 Drawing Sheet

CIRCUIT ARRANGEMENT FOR AN IGNITION STAGE, IN PARTICULAR FOR THE IGNITION CIRCUIT OF A MOTOR VEHICLE

FIELD OF THE INVENTION

The present invention relates to a circuit arrangement for an ignition output stage, in particular for an ignition circuit of a motor vehicle.

BACKGROUND INFORMATION

Low-side ignition circuits and high-side ignition circuits are conventional driving circuit arrangements for an ignition circuit. Multiple Darlington transistor stages (referred to below as Darlingtons) which drive a primary winding of an ignition coil are normally used as power switching elements for the ignition circuits. A distinction is made between low-side ignition and high-side ignition, depending on whether the primary winding is driven by the Darlington collector (low side) or the Darlington emitter (high side).

An ignition circuit which uses a p-n-p Darlington whose collector is connected to ground is described in German Patent No. 37 35 631.3. The emitter is connected to the positive terminal of a voltage source via the primary winding. Because the Darlington base is known to go to negative reverse voltage (blocking voltage) at turn-off, the driving circuit must be isolated from this voltage. The use of an n-p-n driving transistor for this purpose is described in German Patent 37 35 631.3.

SUMMARY OF THE INVENTION

The driving circuit according to the present invention having includes an advantage that the driving circuit can be isolated from a negative reverse voltage present at the base of the Darlington when the latter is turned off, at the same time enabling the decoupling element to be integrated into the Darlington. The provision of an n-p-n Darlington whose collector is connected to the positive terminal of a voltage source and whose emitter is connected to a first terminal of the primary winding of the ignition coil, with the second terminal of the primary winding being connected to ground and the Darlington being driven by a decoupling element, makes it possible to assemble the entire ignition output stage cost-effectively and with simple manufacturing techniques, in particular due to the ability inherent in the circuit arrangement to integrate the Darlington, the decoupling element, and the entire driving circuit into a monolithically integrated component. The driving circuit according to the present invention is further has a highly reliable ignition output stage when exposed to thermal stresses which occur under extreme operating conditions.

An especially advantageous of the present invention is the fact that the ability to integrate the decoupling element into an n-p-n Darlington considerably simplifies the electrical and thermal coupling of the ignition output stage with a heat sink connected to ground. The negative blocking voltage of around 300 to 400 V, which arises upon turning off of the Darlington, thus no longer needs to be insulated against a ground heat sink. It can therefore be advantageous to place the ignition output stages, a suitable number of which is provided, depending on the number of cylinders in the internal combustion engine to be driven, in a compact ignition system, since complicated measures to provide insulation between the collectors of the individual Darlingtons and against the ground heat sink are no longer necessary. Because all of the Darlington collectors can be connected together to a voltage bus attached to the positive terminal of the voltage source, this voltage bus alone has to be insulated against ground. This can be done with little effort, due to the relatively low voltage that is present, on the order of 14 V.

DETAILED DESCRIPTION

Figure 1:
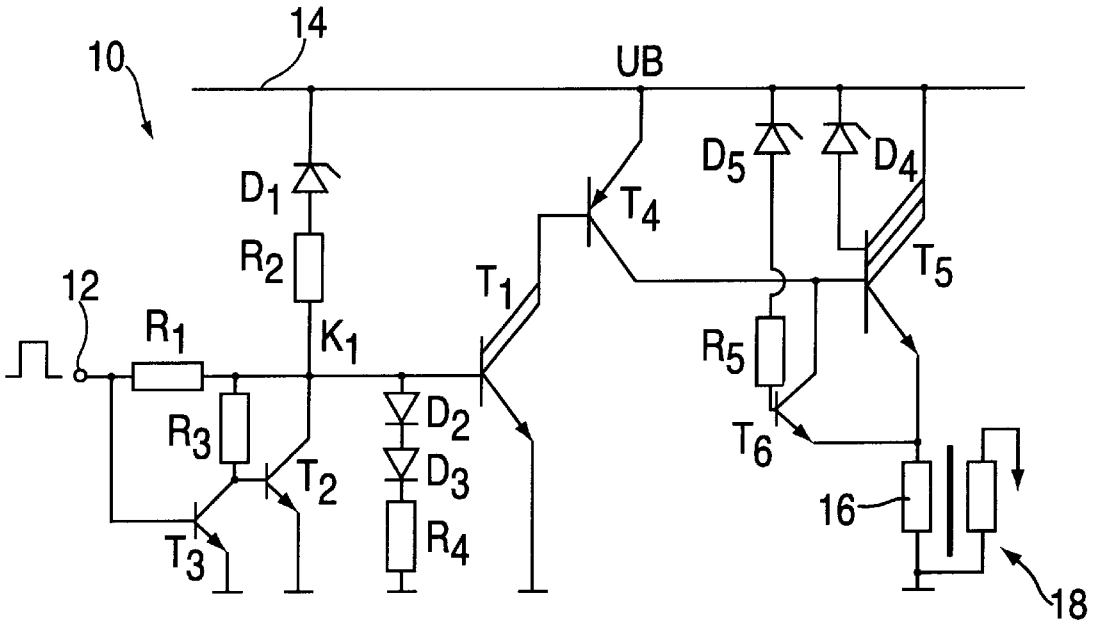
FIG. 1 shows a circuit diagram of an ignition output stage according to the present invention.

FIG. 1 shows circuit arrangement 10 of an ignition output stage for an internal combustion engine in accordance with the present invention. Although FIG. 1 shows only one ignition output stage, multiple ignition output stages can be provided, depending on the number of cylinders in the internal combustion engine.

The output signal indicated here of an engine control unit is connected to an input terminal 12. Terminal 12 is connected to the base of a dual Darlington $T_1$ via a resistor $R_1$. A node $K_1$ located between resistor $R_1$ and the base of transistor $T_1$ is connected to positive terminal 14 of a voltage source, for example a car battery, via a resistor $R_2$ and a Zener diode $D_1$. Node $K_1$ is also connected to the collector of a transistor $T_2$ whose emitter is connected to ground and whose base is connected to node $K_1$ and to the collector of a further transistor $T_3$ via a resistor $R_3$. The emitter of transistor $T_3$ is connected to ground, and the base of transistor $T_3$ is connected to input terminal 12. Node $K_1$ is also connected to ground via a series arrangement of diodes $D_2$ and $D_3$ and via a resistor $R_4$.

The collector of transistor $T_1$ is connected to the base of a lateral p-n-p transistor $T_4$. The emitter of transistor $T_1$ is connected to ground. The emitter of transistor $T_4$ is connected to positive terminal 14, while the collector of transistor $T_4$ is connected to the base of a triple Darlington $T_5$. The collector of Darlington $T_5$ is connected to positive terminal 14. A Zener diode $D_4$ is positioned in the base-collector link of Darlington $T_5$ The emitter of Darlington $T_5$ is connected to one terminal of a primary winding 16 of an ignition coil 18, whose other terminal is connected to ground. The emitter of Darlington $T_5$ is connected to the emitter of a further transistor $T_6$, whose collector is connected to the base of Darlington $T_5$. The base of transistor $T_6$ is connected to positive terminal 14 via a resistor $R_5$ and via a Zener diode $D_5$.

The circuit arrangement shown in FIG. 1 performs the following functions:

The engine electronics provides a driving signal for triggering the ignition of a motor vehicle spark plug connected to circuit arrangement 10. Resistor $R_1$ is a high-resistance resistor rated at 500 to 1,000 ohms, for example, and serves as an interference-suppression resistor to avoid errors in driving transistor $T_1$. Resistor $R_1$ makes the base of this transistor insensitive to sudden voltage peaks. Transistor $T_1$ converts the positive driving signal at input terminal 12 to an inverted signal used to drive transistor $T_4$, thereby turning the latter on. Darlington $T_5$, which drives ignition coil 18, is activated while transistor $T_4$ is on. The cascade of transistors $T_1$, $T_4$, and $T_5$ thus drives ignition coil 18, depending on the presence of a positive input signal.

Transistor $T_6$ connected to the base-emitter link of Darlington $T_5$ and the series arrangement of resistor $R_5$ and Zener diode $D_5$ connecting the base of transistor $T_6$ to positive terminal 14 perform a restart lockout function. If reverse voltages that are higher than the reverse voltage of Zener diode $D_5$ (typically 35 V) occur during Darlington $T_5$ turn-off, transistor $T_6$ short-circuits the base and emitter of Darlington $T_5$.

Lateral p-n-p transistor $T_4$ forms a coupling element which decouples the driving circuit, shown to its left in FIG. 1, from Darlington $T_5$ when the latter is turned off.

The series arrangement of diodes $D_2$, $D_3$, and resistor $R_4$ forms a current balancing circuit that is used to set and limit the 10 collector current of transistor $T_1$. Diodes $D_2$ and $D_3$ are switched in the forward direction, i.e. their anodes are connected to the base of transistor $T_1$. The collector current of transistor $T_1$ is set to a value dependent on resistor $R_4$, 100 mA, for example.

The series arrangement of Zener diode $D_1$ and resistor $R_2$ is used to protect circuit arrangement 10 against voltage surges in the power supply system. If a surge (load dump) whose value is higher than the breakdown voltage of Zener diode $D_1$ occurs in the power supply system, this surge is discharged. The circuit arrangement of transistors $T_2$ and $T_3$ and resistor $R_3$ simultaneously connected to node $K_1$ forms a logic circuit which discharges the current produced by the voltage surge (load dump current) either to the base of transistor $T_1$ or to ground, depending on the presence of a positive control signal at input terminal 12. If no driving signal is present at input terminal 12, transistor $T_2$ is switched through, thus allowing the load dump current to be discharged to ground via node $K_1$ and transistor $T_2$. If a positive driving signal is present at 30 input terminal 12 at the time a load dump current occurs, the load dump current is discharged to the base of transistor $T_1$ via node $K_1$.

Figure 2:
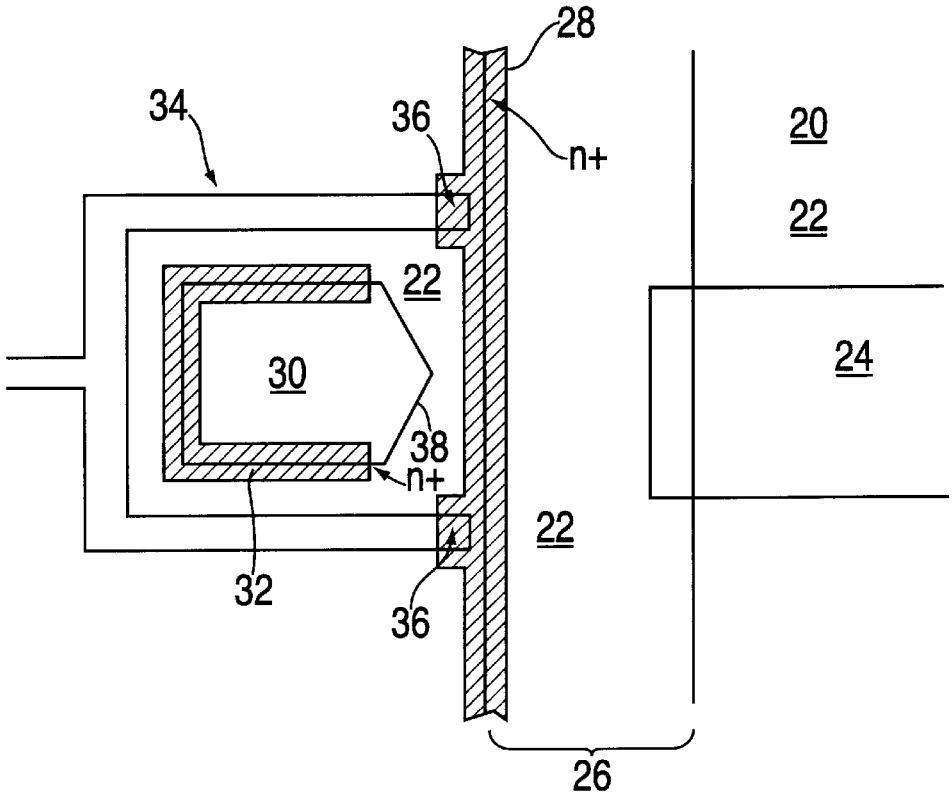
FIG. 2 shows a schematic top view of a portion of the ignition output stage in a monolithically integrated component according to the present invention.

FIG. 2 shows a partial view of the layout of circuit 35 arrangement 10 illustrated in FIG. 1 for the purpose of explaining, in particular, the integration of Darlington $T_5$ and decoupling transistor $T_4$ into a monolithically integrated component.

FIG. 2 shows a section of a wafer 20. Wafer 20 is composed of an n-type substrate 22 with an n-type dopant. A region 24 with a p-type dopant is patterned in n-type substrate 22. Region 24 forms the base of Darlington $T_5$ and, at the same time, the collector of decoupling transistor $T_4$. The base of Darlington $T_5$ is partially covered by a counter-electrode 26 which is connected to positive terminal 14 shown in FIG. 1 via an n+ contact strip 28. Counter-electrode 26 thus forms the collector of Darlington $T_5$. A further region 30 with a p-type dopant is patterned in wafer 20. Region 30 is patterned outside the region of counter-electrode 26 on the side facing away from p-type region 24. Region 30 forms the emitter of decoupling transistor $T_4$, while n-type substrate 22 between regions 24 and 30 forms the base of transistor $T_4$. This produces a lateral p-n-p transistor $T_4$ which is integrated into the edge area of Darlington $T_5$ Region 30 is surrounded on three sides by an n+ ring 32, which is also contacted with positive terminal 14 shown in FIG. 1. Region 30 is surrounded by a conductor path 34 which is contacted with n+ contact strip 28. Region 30 can be contacted on both sides, for example using contact windows 36 illustrated here. Conductor path 34 leads to the collector of transistor $T_1$, which is not illustrated in the section shown in FIG. 2. Region 30 is provided with a wedge-shaped pattern pointing in the direction of n+ contact strip 28.

Based on the layout shown in FIG. 2, the switching function of transistors $T_4$ and $T_5$ is achieved as follows:

To turn on lateral transistor $T_4$ the potential of n-type substrate 22 between regions 24 and 30 must be brought to a lower voltage than the supply voltage (14 volts) present at n+ contact strip 28. To do this, the base current of lateral transistor $T_4$ is supplied from transistor $T_1$ located outside the high-cutoff region of Darlington $T_5$. Via the connection between the collector of transistor $T_1$ and n+ contact strip 28, the n+ zone between regions 24 and 30 is pulled to a more negative potential than substrate 22 as a whole. This turns on transistor $T_4$, whose emitter forms region 30, whose collector forms region 24, and whose base forms substrate 22 located between these regions. Due to wedge-shaped pattern 38 of region 30, the central zone with the lower voltage drop located between the two contact windows 36 is leveled with respect to the zones with a higher voltage drop located in the direction of contact windows 36. As a result, a more uniform lateral current can flow between regions 30 and 24, thus improving the gain.

Regions 30 and 24 must be spaced a minimum distance apart, due to the expansion of the space charge region when Darlington $T_5$ is in cutoff mode. In the application shown, the advantageous distance is at least 55 $\mu$m. This yields a current gain of 0.1 for lateral transistor $T_4$.

With this arrangement, therefore, a driving current for Darlington $T_5$ can flow across the blocking edge pattern of Darlington $T_5$ without interfering with the cutoff behavior of Darlington $T_5$ upon turn-off. Based on a current gain of around 0.1, a collector current of inverting transistor $T_1$, amounting to around 100 mA, can be used to generate a driving current of around 10 mA for Darlington $T_5$. This makes it possible to operate Darlington $T_5$ at around 10 A.

The remaining circuit elements of circuit arrangement 10 explained in connection with FIG. 1, but not illustrated in FIG. 2, can be arranged outside the region surrounded by counter-electrode 26 on wafer 20. A dividing resistor of counter-electrode 26 can very advantageously be used simultaneously as current-limiting resistor $R_5$ for short-circuit transistor $T_6$.

What is claimed is:

1. A circuit arrangement of an ignition output stage for a motor vehicle, comprising:

an n-p-n Darlington transistor for driving a primary winding of an ignition coil, a collector of the Darlington transistor being coupled to a positive terminal of a voltage source, an emitter of the Darlington transistor being coupled to a first terminal of the primary winding of the ignition coil, and a second terminal of the primary winding of the ignition coil being coupled to ground;

a lateral p-n-p transistor isolating a driving circuit from the Darlington transistor, a collector of the lateral p-n-p transistor being coupled to a base of the Darlington transistor, an emitter of the lateral p-n-p transistor being coupled to the positive terminal of the voltage source, and a base of the lateral p-n-p transistor being driven by the driving circuit; and a first p-type region in an n-type substrate forming the base of the Darlington transistor and the collector of the p-n-p transistor.

2. The circuit arrangement according to claim 1, wherein the driving circuit includes a first transistor, a collector of the first transistor being coupled to the base of the lateral p-n-p transistor, an emitter of the first transistor being coupled to ground, and a base of the first transistor being driven by a control signal, the control signal triggering ignition.

3. The circuit arrangement according to claim 1, wherein the Darlington transistor and the lateral p-n-p transistor are monolithically integrated in a wafer.

4. The circuit arrangement according to claim 1, further comprising:

a second p-type region positioned at a distance from the first p-type region, the second p-type region forming the emitter of the lateral p-n-p transistor, wherein a portion of the n-type substrate located between the first p-type region and the second p-type regions and limited by an n+ contact strip forms the base of the lateral p-n-p transistor.

5. The circuit arrangement according to claim 4, wherein the n+ contact strip contacts a counter-electrode which is positioned over the portion of the n-type substrate.

6. The circuit arrangement according to claim 4, further comprising:

a n+ ring surrounding the second p-type region except for a side facing the n+ contact strip, the n+ ring being connected to the positive terminal.

7. The circuit arrangement according to claim 6, further comprising:

a conductor path surrounding the second p-type region, the conductor path being contacted with the n+ contact strip on both sides of the second p-type region.

8. The circuit arrangement according to claim 4, wherein the second p-type region includes a wedge-shaped pattern pointing in a direction of the n+ contact strip.

* * * * *